US007520758B2

(12) United States Patent
Kim

(10) Patent No.: US 7,520,758 B2
(45) Date of Patent: Apr. 21, 2009

(54) REFRIGERATOR

(75) Inventor: Young Ryul Kim, Gwangju (KR)

(73) Assignee: Samsung Gwangju Electronics Co. Ltd., Gwangsan-gu, Gwangju (KR)

( * ) Notice: Subject to any disclaimer, the term of this patent is extended or adjusted under 35 U.S.C. 154(b) by 0 days.

(21) Appl. No.: 11/901,133

(22) Filed: Sep. 14, 2007

(65) Prior Publication Data

US 2008/0113529 A1 May 15, 2008

(30) Foreign Application Priority Data

Nov. 13, 2006 (KR) ..... 10-2006-0111657

(51) Int. Cl.
*H01R 12/00* (2006.01)

(52) U.S. Cl. ..... 439/76.1

(58) Field of Classification Search ..... 439/76.1, 439/65–67; 361/42, 695, 704, 719
See application file for complete search history.

(56) References Cited

U.S. PATENT DOCUMENTS 5,648,892 A * 7/1997 Wieloch et al. ..... 361/788
5,907,475 A * 5/1999 Babinski et al. ..... 361/719
5,930,112 A * 7/1999 Babinski et al. ..... 361/695
2007/0230072 A1 * 10/2007 Zhang et al. ..... 361/42
2008/0041843 A1 * 2/2008 Bower et al. ..... 219/544

FOREIGN PATENT DOCUMENTS

JP 05-205532 8/1993

* cited by examiner

*Primary Examiner*—Jean F Duverne
(74) *Attorney, Agent, or Firm*—Ohlandt, Greeley, Ruggiero & Perle, L.L.P.

(57) ABSTRACT

Disclosed is a refrigerator, in which the installation and the repair and replacement of a wire harness are easily achieved. In a refrigerator, in which a main body includes an inner casing, an outer casing, and a heat insulating layer provided between the inner and outer casings, and electric and electronic components including sensors and switches are electrically connected to a printed circuit board through a wire harness, an opening is formed through one side of the main body, and a harness block in which the wire harness and a plurality of connection housings for installing the wire harness are intensively disposed is detachably installed in the opening.

7 Claims, 4 Drawing Sheets

REFRIGERATOR

CROSS-REFERENCE TO RELATED APPLICATION

This application claims the benefit of Korean Patent Application No. 2006-111657, filed Nov. 13, 2006, in the Korean Intellectual Property Office, the disclosure of which is incorporated herein by reference.

BACKGROUND OF THE INVENTION

1. Field of the Invention

The present disclosure relates to a refrigerator, and more particularly, to a refrigerator, in which the installation and the repair and replacement of a wire harness are easily achieved.

2. Description of the Related Art

Generally, in refrigerators, a heat insulating layer is formed between an inner casing for forming a storage space and an outer casing for forming the outer surface of a main body by filling a gap therebetween with urethane foam, and electric and electronic components of the refrigerator, such as various sensors and switches, are electrically connected to a printed circuit board by a wire harness disposed through the heat insulating layer.

A plurality of connection housings for fixing the wire harness disposed between the inner and outer casings to the inner casing are installed on the inner casing. The connection housings are fixed by urethane foam filling the gap between the inner and outer casings for forming the heat insulating layer under the condition that one end of each of the connection housings is inserted into the inner casing.

That is, the connection housings are inserted into fixing holes formed in the inner casing before the gap between the inner and outer casings is filled with urethane foam. Then, when the gap between the inner and outer casings is filled with urethane foam under the above state, portions of the connection housings located between the inner and outer casings are surrounded with the heat insulating layer, and thus the connection housings can be fixed to the inner casing.

In the above conventional refrigerator, the plurality of connection housings for installing and fixing the wire harness are complicatedly dispersed throughout whole region of the inner casing, and are fixedly buried in the heat insulating layer obtained by filling the gap between the inner and outer casings, thus being incapable of being taken out of the main body. Therefore, when the repair and replacement of the wire harness is required, it is difficult to separate the connection housings from the refrigerator.

Further, during fixing the plurality of connection housings for installing and fixing the wire harness by filling the gap between the inner and outer casings with urethane foam, urethane foam may leak through gaps between the fixing holes and the connection housings. Accordingly, the gaps between the fixing holes and the connection housings are sealed up by installing a separate sealing member or using a tape or a hot-melt adhesive. Moreover, after the fixation of the connection housings has been completed, the connection housings are electrically connected to the printed circuit board, individually. Therefore, the installation of the wire harness is complicated and difficult.

SUMMARY OF THE INVENTION

Therefore, one aspect of the disclosure is to provide a refrigerator, in which the installation and the repair and replacement of a wire harness are easily achieved.

In accordance with one aspect, the present disclosure provides a refrigerator, in which a main body includes an inner casing, an outer casing, and a heat insulating layer provided between the inner and outer casings, and electric and electronic components including sensors and switches are electrically connected to a printed circuit board through a wire harness, wherein an opening is formed through one side of the main body, and a harness block in which the wire harness and a plurality of connection housings for installing the wire harness are intensively disposed is detachably installed in the opening.

The printed circuit board is inserted into the harness block such that the plurality of connection housings are electrically connected to the printed circuit board.

The harness block includes a harness body having a hollow structure inserted into the opening under the condition that the edge of the harness body is caught by the opening, and a heat insulating material filling the inside of the harness body at the side of the inner casing, wherein the printed circuit board is provided with first connectors and inserted into the inside of the harness body at the side of the outer casing; the plurality of connection housings are fixed to the heat insulating material such that one end of each of the plurality of connection housings is buried in the surface of the heat insulating material at the side of the inner casing; second connectors corresponding to the first connectors are fixed to the heat insulating material such that one end of each of the second connectors is buried in the surface of the heat insulating material at the side of the outer casing; and the wire harness connecting the second connectors and the plurality of connection housings is buried under the heat insulating material.

A receiving groove is formed in one end of the opening at the side of the outer casing, a flange is formed on the outer circumference of one end of the harness body corresponding to the receiving groove such that the flange is caught by the receiving groove, and a gasket is installed between the receiving groove and the flange.

The end of the opening at the side of the outer casing is sealed up with a cover under the condition that the harness block is inserted into the opening.

The heat insulating layer and the heat insulating material are made of urethane.

The harness body and the heat insulating material are integrally made of urethane foam.

BRIEF DESCRIPTION OF THE DRAWINGS

These and/or other aspects and advantages of the disclosure will become apparent and more readily appreciated from the following description of the embodiments, taken in conjunction with the accompanying drawings in which.

DETAILED DESCRIPTION OF THE PREFERRED EMBODIMENTS

Figure 1:
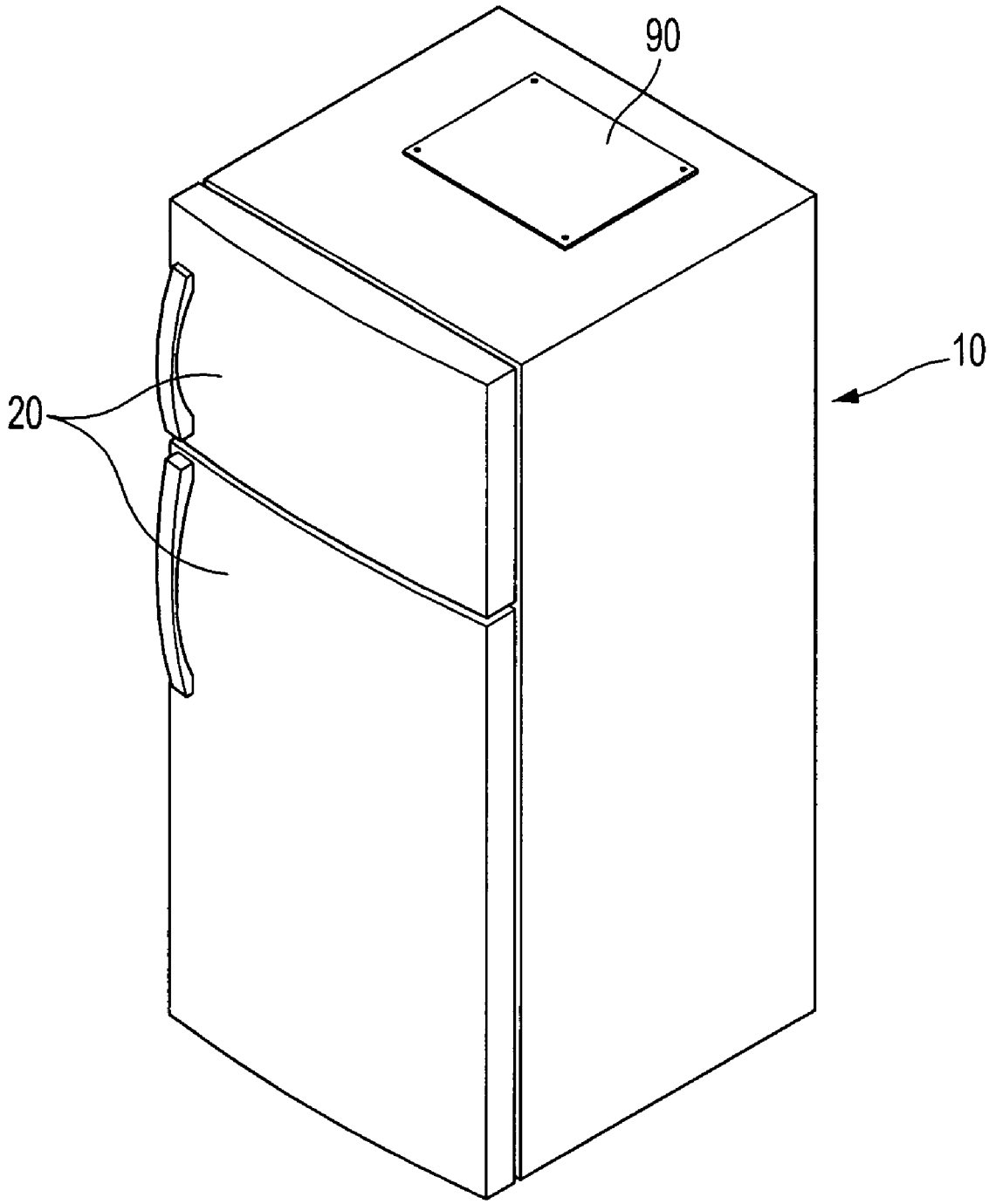
FIG. 1 is a perspective view of a refrigerator in accordance with an embodiment of the present disclosure.

Reference will now be made in detail to an embodiment of the present disclosure, an example of which is illustrated in the accompanying drawings, wherein like reference numerals refer to like elements throughout. An embodiment is described below to explain the present disclosure by referring to the annexed drawings.

A refrigerator in accordance with one embodiment of the present disclosure includes a main body 10 provided with a storage chamber, the front surfaces of which are opened, and doors 20 rotatably hinged to the front surface of the main body 10 for opening and closing the storage chamber. Here, the main body 10 and the doors 20 form the external appearance of the refrigerator. The above refrigerator supplies cool air through evaporators (not shown) of a refrigeration cycle, which are respectively installed on the inner surfaces of the rear portions of the storage chamber, thus storing articles, located in the storage chamber, in a cold or frozen state.

Figure 2:
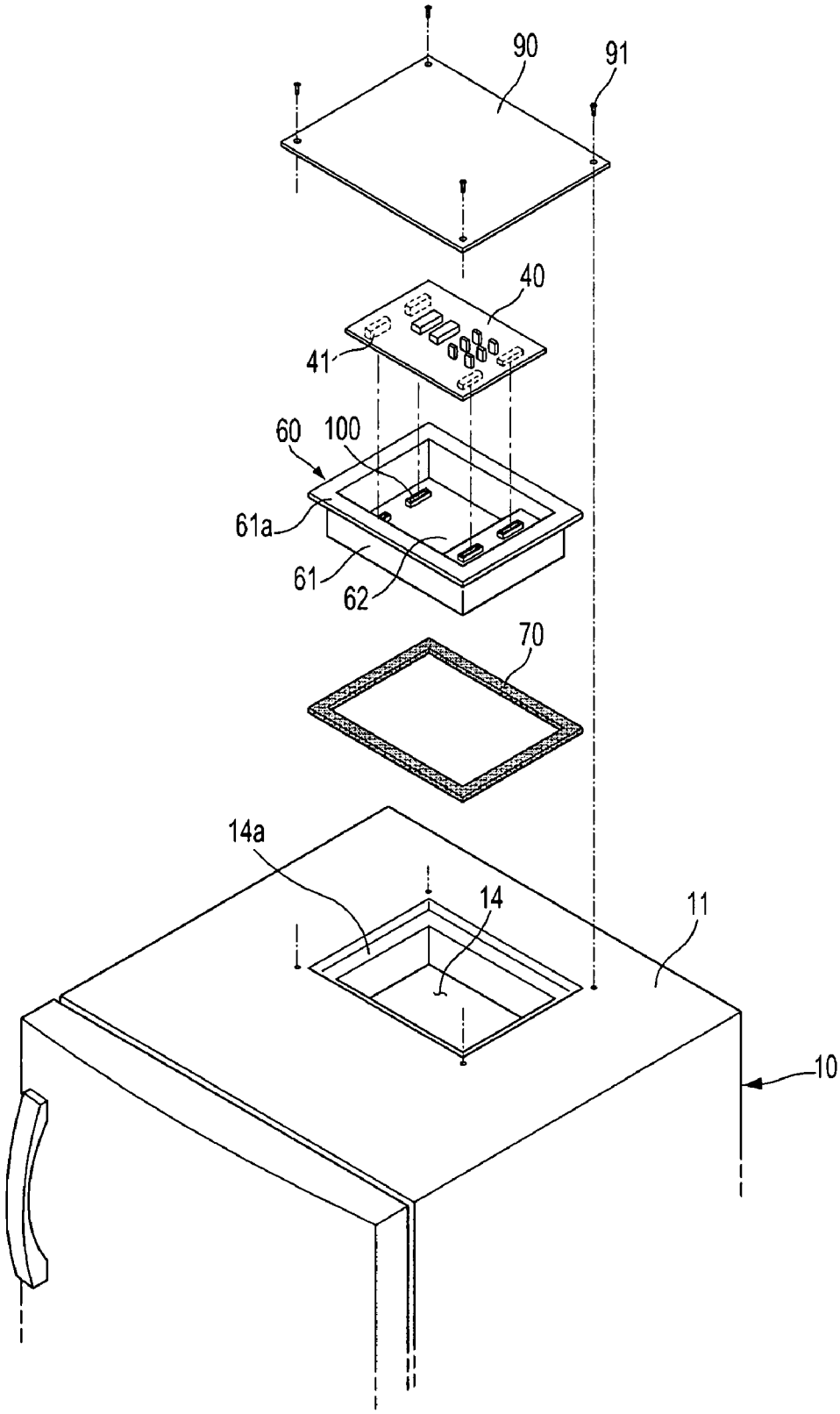
FIG. 2 is an exploded perspective view of a harness block, which is separated from a main body of the refrigerator in accordance with an embodiment of the present disclosure.
Figure 3:
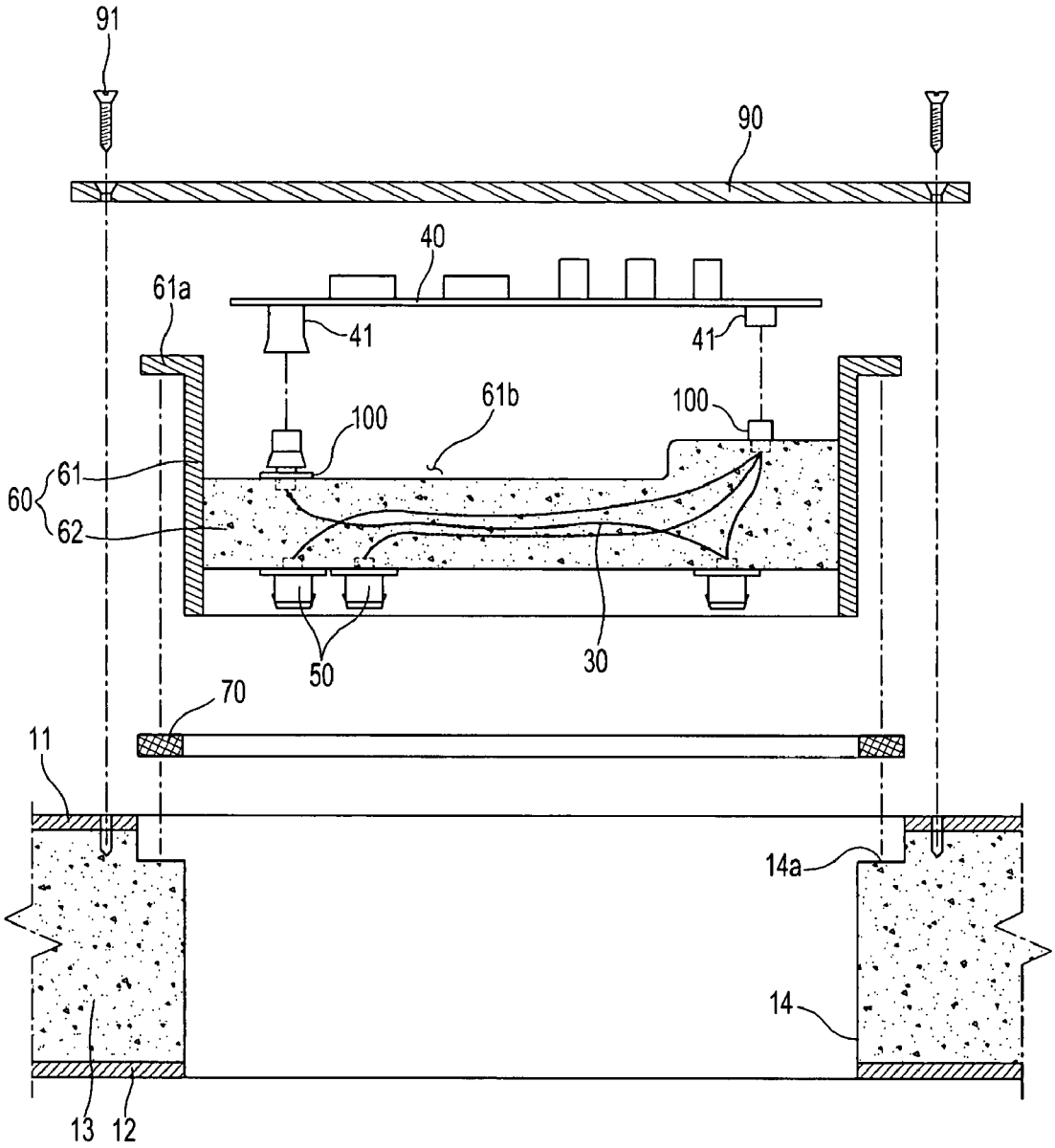
FIG. 3 is a sectional view of the harness block of FIG. 2.
Figure 4:
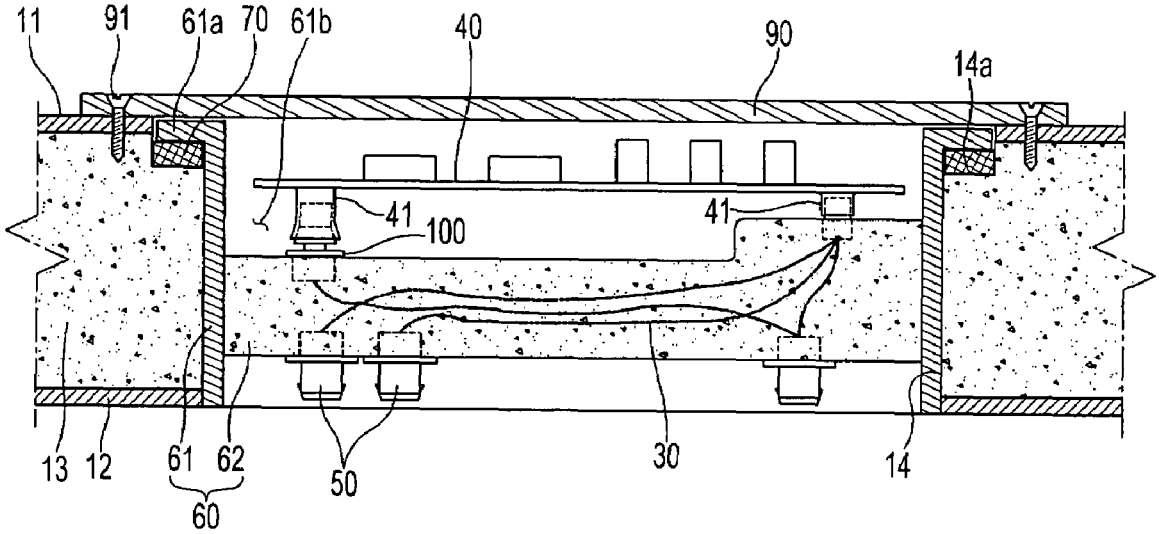
FIG. 4 is a sectional view of the harness block, which is installed on the main body of the refrigerator.

With reference to FIGS. 2 and 3, the main body 10 includes an outer casing 11 provided at the outer portion of the main body 10 for forming the outer surface of the main body 10, an inner casing 12 provided at the inner portion of the main body 10 for forming the storage chamber, and a heat insulating layer 13 formed between the inner and outer casings 11 and 12. The heat insulating layer 13 is obtained by filling a gap between the inner and outer casings 11 and 12 with urethane foam.

Electric and electronic components, such as various sensors and switches, are installed in the refrigerator. These electric and electronic components are controlled under the condition that they are electrically connected to a printed circuit board 40 through a wire harness 30. The refrigerator in accordance with this embodiment has a structure in that the installation and the repair and replacement of the wire harness 30 are easily achieved.

That is, in the refrigerator in accordance with this embodiment, an opening 14 is formed through the center of the main body 10, and a harness block 60, in which the wire harness 30 and a plurality of connection housings 50 for connecting and fixing the wire harness 30 are intensively disposed, is detachably installed in the opening 14.

In a conventional refrigerator, a wire harness and a plurality of connection housings are complicatedly dispersed throughout the whole region of the inner casing. On the other hand, in the refrigerator of the present disclosure, the wire harness 30 and the plurality of connection housings 50 are intensively disposed in the single harness block 60, and thus can be collectively managed and installed. Therefore, the installation of the wire harness 30 is rapidly and conveniently achieved. Further, in the above structure in that the wire harness 30 and the connection housings 50 are easily taken out of the main body 10, the repair and replacement of the wire harness 30 is easily achieved.

Hereinafter, the structure of the harness block 60 will be described in more detail.

With reference to FIGS. 2 and 3, the harness block 60 includes a harness body 61 having a hollow square pillar, which is inserted into the opening 14. A flange 61*a* is formed at the edge of the upper end of the harness body 61 such that the flange 61*a* is caught by the opening 14, and a receiving groove 14*a* having a shape corresponding to the shape of the flange 61*a* is formed in the inner portion of the upper end of the opening 14.

A heat insulating material 62 is provided inside the lower portion of the harness body 61 at the side of the inner casing 12 such that the lower ends of the connection housings 50 are fixedly buried in the heat insulating material 62. The heat insulating material 62 seals the inside of the lower portion of the harness body 61. When the connection housings 50 are fixed by the heat insulating material 62 sealing the inside of the harness body 61, it is possible to prevent thermal conduction between the inside of the storage chamber and the outside of the main body 10 through the opening 14, and thus a loss of cool air of the storage chamber through the opening 14 and the hollow-shaped harness body 61 is reduced. Further, in order to prevent the cool air of the storage chamber from leaking through a gap between the harness body 61 and the opening 14, a gasket 70 for sealing the gap is installed between the flange 61*a* and the receiving groove 14*a*, and the upper end of the opening 14 at the side of the outer casing 11 is sealed up with a cover 90 under the condition that the harness block 60 is inserted into the opening 14.

In this embodiment, the harness body 61 is manufactured by injection molding, and the heat insulating material 62 is made of urethane foam, which is the same material of the heat insulating layer 13, and is attached to the inside of the harness body 61. However, the harness body 61 and the heat insulating material 62 may be integrally made of urethane foam. For reference, non-described reference numeral 91 represents fixing bolts connected to the cover 90 for fixing the cover 90 to the outer surface of the outer casing 11 around the opening 14.

The connection housings 50 installed on the heat insulating material 62 are electrically connected to the printed circuit board 40 so as to control the electric and electronic components. In the refrigerator. in accordance with this embodiment, the inside of the harness body 61 of the harness block 60 on the upper surface of the heat insulating material 62 forms a receiving space 61*b* for receiving the printed circuit board 40, and the printed circuit board 40 is inserted into the receiving space 61*b* such that the connection housings 50 are electrically connected to the printed circuit board 40.

For this reason, a plurality of first connectors 41 are installed on the lower surface of the printed circuit board 40, and a plurality of second connectors 100 corresponding to the plurality of first connectors 41 are installed on the upper surface of the heat insulating material 62. Here, the second connectors 100 are fixed to the heat insulating material 62 such that the lower ends of the second connectors 100 are buried in the upper portion of the heat insulating material 62, and the wire harness 30 is buried in the heat insulating material 62 such that the wire harness 30 electrically connects the connection housings 50 and the second connectors 100.

The heat insulating material 62 is formed by filling a mold having a shape corresponding to the desired shape of the heat insulating material 62 with urethane foam. The second connectors 100 and the connection housings 50 are fixed to the heat insulating material 62 such that one end of each of the second connectors 100 and the connection housings 50 is buried in the heat insulating material 62 during the process for forming the heat insulating material 62 by filling the mold with urethane foam, and the wire harness 30 is buried in the heat insulating material 62 such that the wire harness 30 electrically connects the second connectors 100 and the connection housings 50.

In the above structure, the printed circuit board 40 is simply fixedly inserted into the inside of the harness body 61 above the heat insulating material 62 only by connecting the first connectors 41 and the second connectors 100 in a one touch manner, thus being electrically connected to the connection housings 50 through the wire harness 30. Under the above state, the electric and electronic components are connected to the printed circuit board 40 by connecting connectors of another wire harness connected to the electric and electronic components to the connection housings 50, thus being controlled through the printed circuit board 40.

Accordingly, the refrigerator in accordance with this embodiment does not cause inconvenience of individually connecting the connection housings 50 to the printed circuit board 40 so as to connect the electric and electronic components to the printed circuit board 40.

Further, the above-described refrigerator in accordance with this embodiment does not require fixing holes formed in the inner casing 12 for installing the connection housings 50, and thus does not cause a possibility of leaking urethane foam, filling the gap between the inner and outer casings 12 and 11 for forming the heat insulating layer 13, to the outside. Therefore, the installation of the wire harness 30 is easily achieved, and the formation of the heat insulating layer 13 is simply achieved.

As apparent from the above description, the present disclosure provides a refrigerator in which a plurality of connection housings, which are dispersed throughout the whole region of an inner casing of a conventional refrigerator, and a wire harness, which is disposed between inner and outer casings of the conventional refrigerator, are intensively disposed in one harness block detachably installed at one side of a main body. Therefore, the plurality of connection housings and the wire harness are collectively managed and installed, and thus the installation of the wire harness is rapidly and conveniently achieved. Further, the plurality of connection housings and the wire harness are easily taken out of the main body, and thus the repair and replacement of the wire harness is easily achieved.

Although embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, having a main body that includes an inner casing, an outer casing, and a heat insulating layer provided between the inner and outer casings, and electric and electronic components including sensors and switches are electrically connected to a printed circuit board through a wire harness, comprising:

an opening formed through one side of the main body, and a harness block in which the wire harness and a plurality of connection housings for installing the wire harness are disposed that is detachably installed in the opening, wherein the harness block includes a harness body having a hollow structure inserted into the opening and an edge so that the edge of the harness body is caught by the opening, and a heat insulating material filling the inside of the harness body at a side of the inner casing, wherein the wire harness is in the heat insulating material.

2. The refrigerator according to claim 1, wherein the printed circuit board is inserted into the harness block such that the plurality of connection housings are electrically connected to the printed circuit board.

3. The refrigerator according to claim 2, wherein:

the printed circuit board is provided with first connectors and inserted into the inside of the harness body at the side of the outer casing, and the plurality of connection housings are fixed to the heat insulating material such that one end of each of the plurality of connection housings is buried in the surface of the heat insulating material at the side of the inner casing; and second connectors corresponding to the first connectors are fixed to the heat insulating material such that one end of each of the second connectors is buried in the surface of the heat insulating material at the side of the outer casing, and the wire harness connecting the second connectors and the plurality of connection housings is buried in the heat insulating material.

4. The refrigerator according to claim 1, wherein a receiving groove is formed in one end of the opening at the side of the outer casing, a flange is formed on the outer circumference of one end of the harness body corresponding to the receiving groove such that the flange is caught by the receiving groove, and a gasket is installed between the receiving groove and the flange.

5. The refrigerator according to claim 2, wherein the end of the opening at the side of the outer casing is sealed up with a cover under the condition that the harness block is inserted into the opening.

6. The refrigerator according to claim 3, wherein the heat insulating layer and the heat insulating material are made of urethane.

7. The refrigerator according to claim 3, wherein the harness body and the heat insulating material are integrally made of urethane foam.

* * * * *